US008261373B2

(12) United States Patent
Detsis

(10) Patent No.: US 8,261,373 B2
(45) Date of Patent: Sep. 11, 2012

(54) DECORATIVE NECKLESS

(76) Inventor: Elizabeth M. Detsis, Malverne, NY (US)

( * ) Notice: Subject to any disclaimer, the term of this patent is extended or adjusted under 35 U.S.C. 154(b) by 884 days.

(21) Appl. No.: 11/220,209

(22) Filed: Sep. 6, 2005

(65) Prior Publication Data

US 2006/0005576 A1 Jan. 12, 2006

Related U.S. Application Data

(63) Continuation of application No. 10/428,624, filed on May 2, 2003, now abandoned.

(60) Provisional application No. 60/378,853, filed on May 8, 2002.

(51) Int. Cl.
*A41F 15/00* (2006.01)

(52) U.S. Cl. ..... 2/300; 450/1; 63/33; 2/323

(58) Field of Classification Search ..... 63/3, 3.1, 63/3.2, 4, 20; 2/323, 406; 450/86, 88
See application file for complete search history.

(56) References Cited

U.S. PATENT DOCUMENTS

| | | | | | |
|---|---|---|---|---|---|
| 1,924,132 | A | * | 8/1933 | Santsaver | 24/532 |
| 2,063,104 | A | * | 12/1936 | Kibbe | 450/86 |
| 2,183,831 | A | * | 12/1939 | Dusablond | 24/66.2 |
| 2,649,639 | A | * | 8/1953 | Carlin | 24/518 |
| 3,456,457 | A | * | 7/1969 | Cass | 63/33 |

* cited by examiner

*Primary Examiner* — Jack W. Lavinder
(74) *Attorney, Agent, or Firm* — Roger M. Rathbun

(57) ABSTRACT

A necklace that does not fully encircle the neck of the user but, instead, has its two free ends with an affixing device at each free end to attach to the straps of the wearers garment or undergarment, such as a bra. In the preferred embodiment, the straps have a plurality of affixing devices vertically spaced along the strap so as to enable the user to position the necklace at differing heights on the wearer to suit the particular neckline of the attire worn by the user. In addition, the affixation and removal of the necklace takes place at the front of the wearer and thus is more convenient and easier to carry out than the use of a clasp that is intended to be manipulated behind the neck of the wearer.

1 Claim, 6 Drawing Sheets

10
12
14
16
18
20
22
24
26

DECORATIVE NECKLESS

REFERENCE TO RELATED CASES

The present patent application is a continuation application of U.S. Ser. No. 10/428,624, filed May 2, 2003, now abandoned and entitled DECORATIVE NECKLESS and which, in turn, was based upon and claims priority to U.S. Provisional application Ser. No. 60/378,853, filed May 8, 2002.

BACKGROUND OF THE INVENTION

The present invention relates to a decorative necklace or other form of jewelry and, more particularly, to an item of jewelry that does not fully encircle the neck of the wearer but has its ends affixed to the strap of a wearer's garment, such as an undergarment.

There are, of course, various types of necklaces used as decorative attachments to a wearer and which are of a wide variety of shapes and sizes to appeal to the wearer and/or to match the other clothing being worn by the wearer. In particularly, however, if there is at least one common feature of all necklaces, it is the feature that the necklace encircles the neck of the wearer. As such, with such necklaces, the position of the ornamental feature, if there is one, is directly in the front of the wearer and its exact location is somewhat constrained by the clasp location and the length of the necklace itself. In addition, for some wearers, it is rather inconvenient to have to manage the clasp at the rear of the since many clasps are quite small and difficult to manipulate to engage and disengage by the wearer of the necklace.

Thus, it is sometimes necessary for the wearer of a necklace to seek the aid of another person to engage and disengage the clasp and, again, not only is that somewhat inconvenient but there are times that no such addition person is available and the wearer is left alone to struggle with the manipulation of the clasp without the ability to actually view the clasp in attempting to close the clasp to secure the necklace in place about the neck of the wearer.

In addition, with the present necklaces that have their free ends joined together with a clasp, the location of the necklace, and in particular, the ornamental feature, is located at a fairly fixed position at the front of he user's neck that is determined by the overall length of the necklace. Thus, as the necklace encircles the neck of the wearer, the length of the necklace will automatically fix the location of the ornamental feature at a particular point at the front of the neck of the wearer and that location cannot be readily changed with that type of necklace. As such, if the wearer desires the necklace and its ornamental feature to hang lower of higher than its normal predetermined position due to a different neckline of a particular garment, that fixed position cannot be readily be accomplished with the conventional necklace.

Illustrative of some prior art is U.S. Pat. No. 5,414,903 of Porteous where there is a dental bib holder that has a means of attaching free ends of a strap to a bib to locate that bib to the front of a patient, however, the purpose of Porteous is entirely different than the preset invention and the bib is not adapted to be affixed to the straps of a garment, such as an undergarment of a person. In U.S. Pat. No. 4,855,805 of Mason, there is a necklace that encircles the users neck and which passes through a number of loops affixed to the users garment, however, the necklace of the Mason patent still encircles the neck of the use and does not become affixed to the straps of a garment worn by the user.

Accordingly, it would be advantageous if there were another, more convenient means of affixing a necklace to a wearer and which could be fastened in place without the need to manipulate some intricate clasp behind the neck of the user. It would also be advantageous for such necklace to have the ability and versatility to be easily moved with respect to its conventional location on the wearer so that the location of the front of the necklace, and, if present, the ornamental feature of the necklace, can be moved to and relocated at the desire of the user to a particularly advantageous decorative location on the wearer. In addition it would be a further advantage of the necklace to simply present a new look to the wearer as opposed to the convention necklace and achieve a more presentable appearance of the necklace.

SUMMARY OF THE INVENTION

Now, in accordance with the present invention, there is provided a new and improved means of affixing a necklace about a wearer. In the present invention, the necklace comprises a necklace having free ends that are affixed to the straps of a garment, preferable an undergarment of that wearer. In the preferred embodiment, the necklace is affixed to the bra straps of the wearer, however, as will be seen, the necklace can be affixed to other straps such as a slip or other garment or undergarment.

As such, the necklace of the present invention has an affixing device on each of the free ends and which are then affixed to the particular straps of the undergarment. By such devices, the necklace can be affixed by the user in the front of that person and therefore, the affixation is much easier and more readily facilitated by the user without any manipulation of a clasp located behind the neck of the wearer.

According, the present necklace is more readily affixed and worn by the user and, additionally, the height of the ornamental portion of the necklace of the necklace can be located at a desired location at the front of the wearer's neck and not dictated by the particular length of the necklace as with the conventional necklaces. In addition, in the preferred embodiment, the strap of the undergarment itself can have specially constructed devices that enable the ready attachment of the free ends of the necklace to the straps so that not only is the particular necklace affixed in the front of the individual, but the means of affixation itself is more convention to the wearer.

In the preferred embodiment, the devices that enable the easy affixation on the straps may comprise a plurality of such devices to enable the easy affixation in a number of differing locations to enable the user to select the location of the necklace to the front of the user.

By means of the present necklace, the overall look of the necklace is different than the conventional necklaces and thus presents a new look of the necklace on the wearer that enhances the ornamental value and appearance of the necklace.

These and other improvements and features of the present invention will become better understood from the detailed description of the preferred embodiment set forth below taken in conjunction with the accompanying drawings.

DETAILED DESCRIPTION OF THE INVENTION

Figures 1, 2, 3:
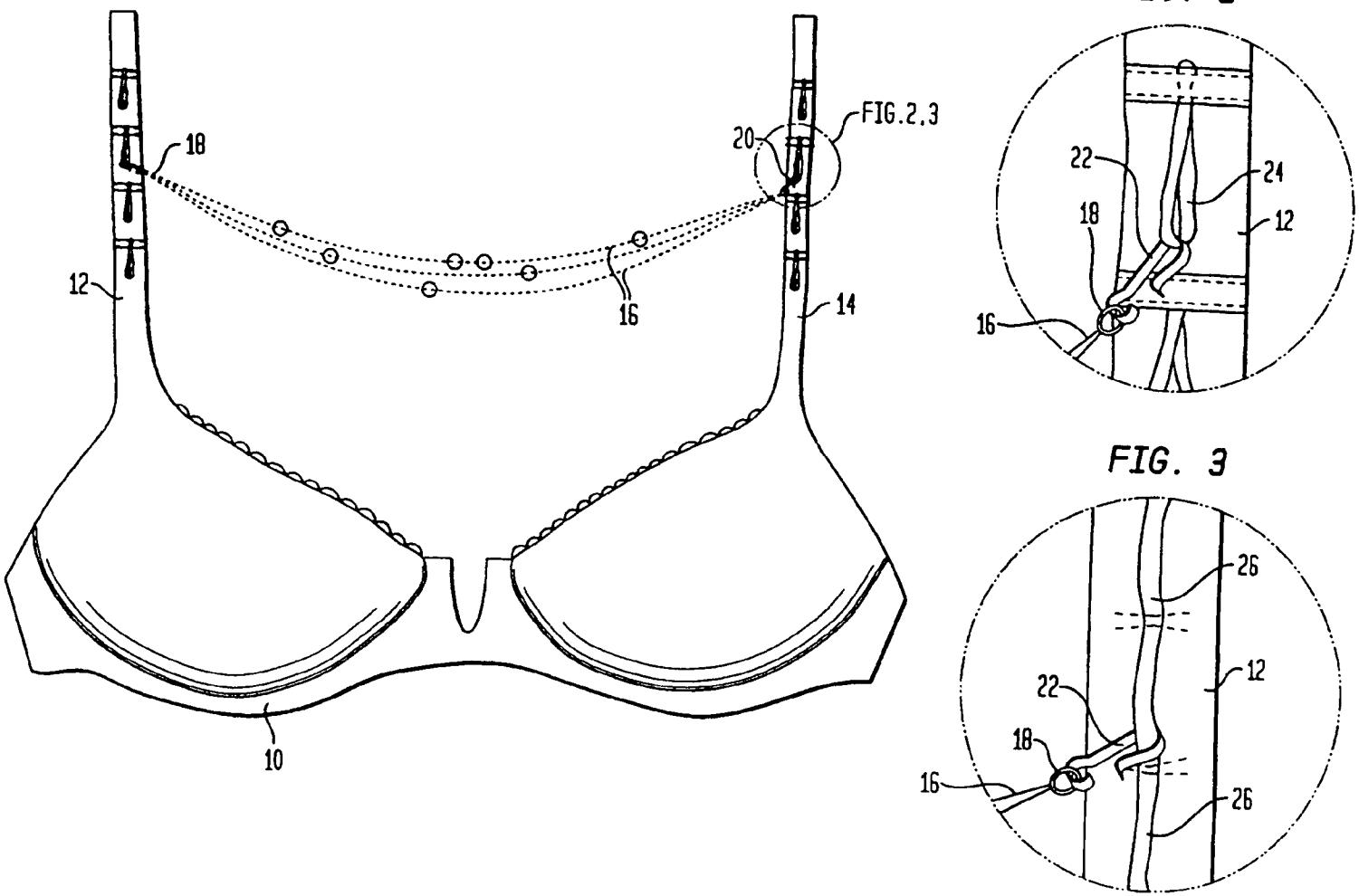
FIG. 1 is a front view of a bra having affixed thereto a necklace in accordance with the present invention.
FIG. 2 is an enlarged view of one means of affixing the free ends of the necklace of the present invention to the straps of the bra of FIG. 1.
FIG. 3 is an enlarged view of an alternative means of affixing the necklace to the straps of the bra of FIG. 2.

Referring now to FIG. 1, there is shown a front view of a bra 10 having a pair of straps 12, 14 as is generally conventional. A necklace 16 made in accordance with the present invention has its two free ends 18, 20 affixed to each of the bra straps 12, 14. Each of the bra straps 12 and 14 have means to facilitate the affixation of each of the free ends 18, 20 to the bra straps 12, 14, respectively. In the Figure, there are differing mean of carrying out that affixation on each of the straps 12, 14 that are shown for illustration purposes only, as any number of differing means may be employed to carry out the attaching of the free ends 18, 20 to the bra straps 12, 14.

Thus, in FIG. 2, there is shown an enlarged front view of one means of affixing the free end 18 of the necklace to the bra strap 12 and, as can be seen, there is a hook 22 at the free end 18 that is attached to a closed link 24 affixed to the bra strap 12. Thus, by having a plurality of links 24 located on the bra strap 12 allows the hook 22 to be attached to any of the links 24 selected by the wearer and, accordingly, the wearer can affix the free end 18 of the necklace 16 at any one of the links 24 so that the location of the necklace can be selected by the wearer as desired to position the ornamental portion of the necklace 16 in the most desirable position, that is, if the wearer has a lower neckline, the free end 18 of the necklace 17 can be affixed to a lower positioned link 24 to allow the necklace 16 to be worn lower at the front of the neck of the wearer.

Conversely, of course, the wearer can just as easily attach the free end 18 of the necklace 16 to an upper situated link 24 so that the necklace 16 can be worn higher on the neck of the user to match whatever neckline is being worn by the wearer. Accordingly, as can be seen by the present invention, the location of the necklace 16 of the wearer can easily and without any difficulty, be worn at any one of many desired locations on the user and just as easily be adjusted as desired.

In FIG. 3, there is another enlarged front view illustrating a further means of attaching the free end 20 of the necklace 16 to the bra strap 14. In this embodiment, there is a plurality of loops 26 formed in the bra strap 14 and again the free end 18 of the bra strap 14 has a hook 22 that can easily be affixed to the loops 26 at whatever loop 26 that is desired by the wearer depending upon the height desired for the necklace 16 along the front of the neck of the wearer.

Figure 4A:
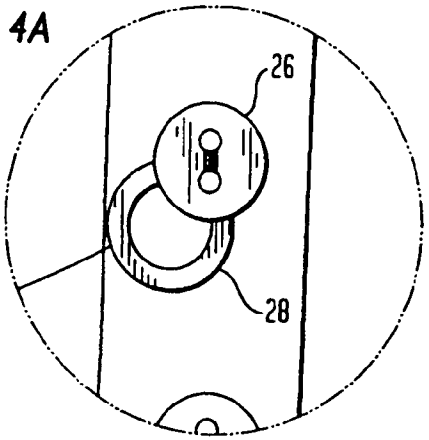
FIG. 4 is a further view of a bra with a still alternate means of affixing the necklace to the strap of a bra.
Figure 4:
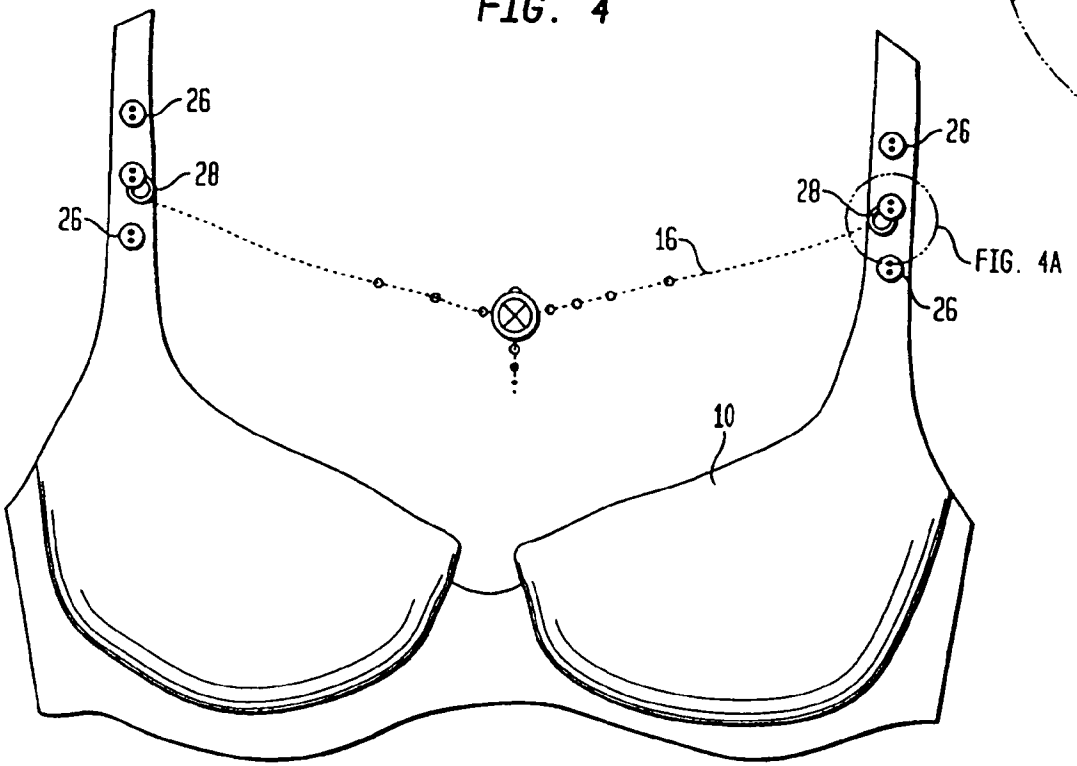

Turning next to FIG. 4, there is a front view of a bra 10 having a necklace 16 affixed thereto and in this Fig., the affixing means comprises a plurality of buttons 26 sewn to the straps 28 of the bra 10 that allows the affixing means, such as small rings 28 at the end of the free ends 30 of the necklace 16 so that, again, the free ends 30 of the necklace 16 can be easily adjusted to any pair of buttons 26 desired by the wearer depending upon the location desired by the wearer on the neck of the user.

Figure 5:
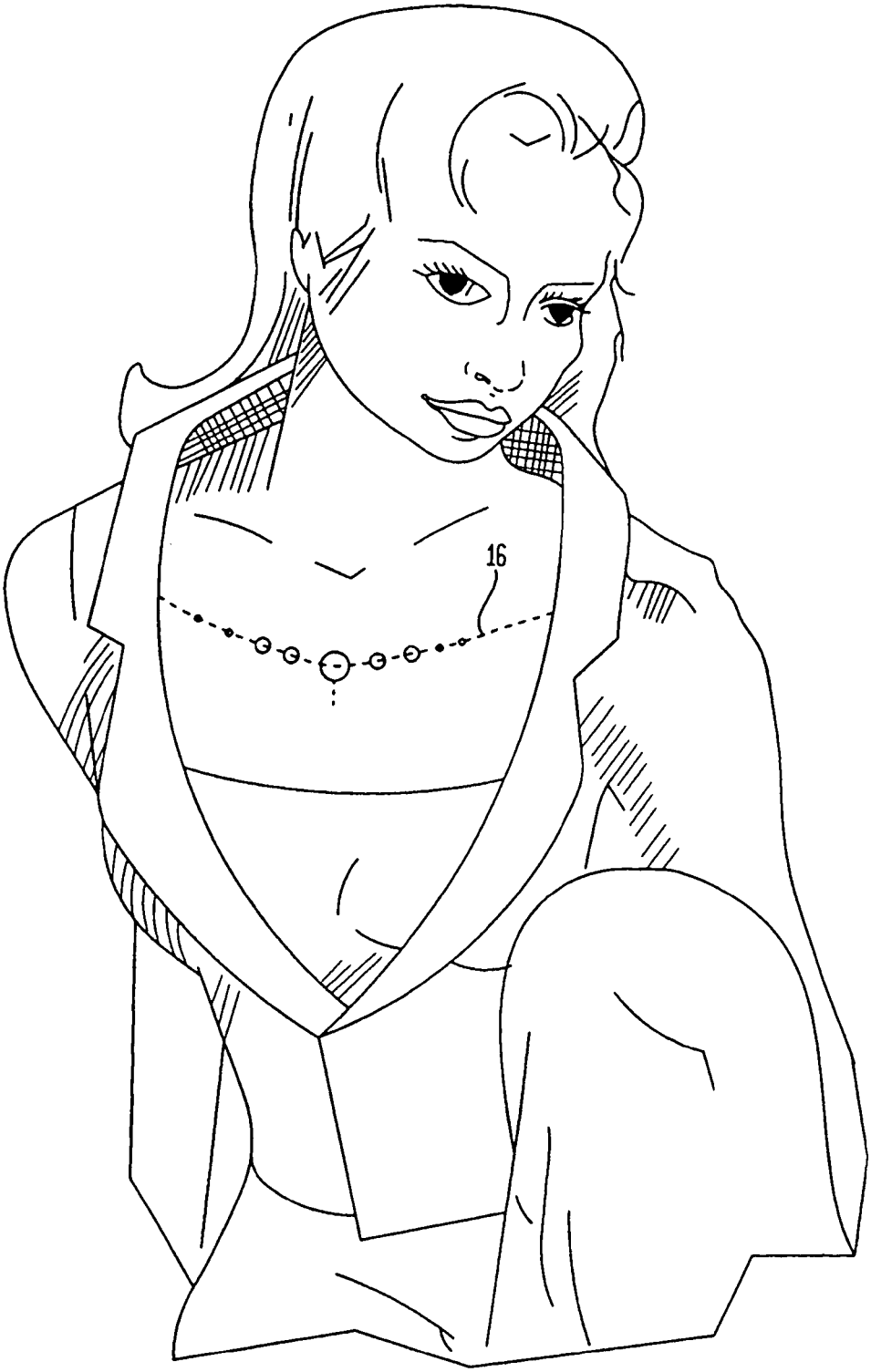
FIG. 5 is a front view of a wearer of a necklace affixed onto the wearer in accordance with the present invention.

Turning now to FIG. 5, there is shown a front view of a necklace 16 in position at the throat of a wearer and, as can be seen, the necklace 16 can be worn low, as shown, or can be repositioned to any particular location of the throat desired by the user.

Figure 6:
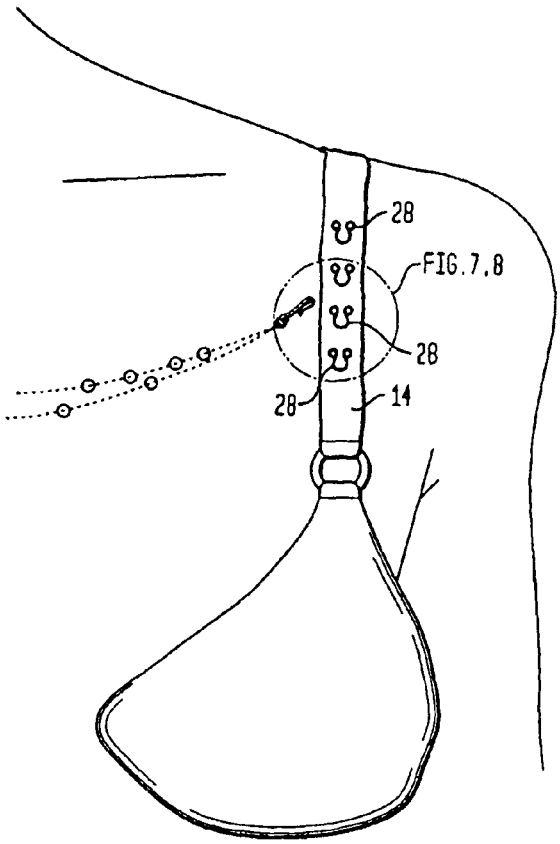
FIGS. 6-8 are front views of an embodiment of the present invention as well as enlarged views of an affixation to the strap of a garment of the wearer.
Figure 7:
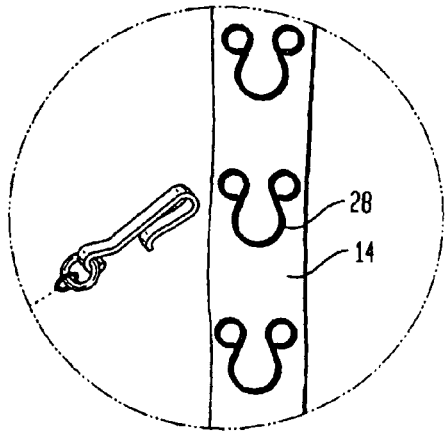
Figure 8:
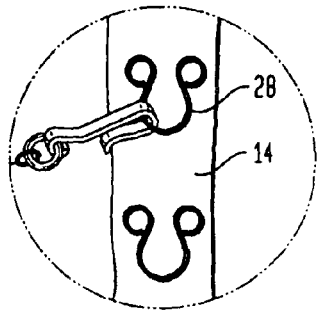

Next, turning to FIGS. 6-8, there is shown a further embodiment of the subject invention and where the bra strap 14 includes a plurality of garment loops 28 that are of the type that are sewn to the material of the bra strap 14. As can be seen in this embodiment, the garment loops are thus sewn to the bra strap 14 at predetermined intervals and the ends of the necklace 16 include hooks 30 that can be readily affixed to any of the desired garment loops 28 to secure that necklace to the wearer.

Figure 9:
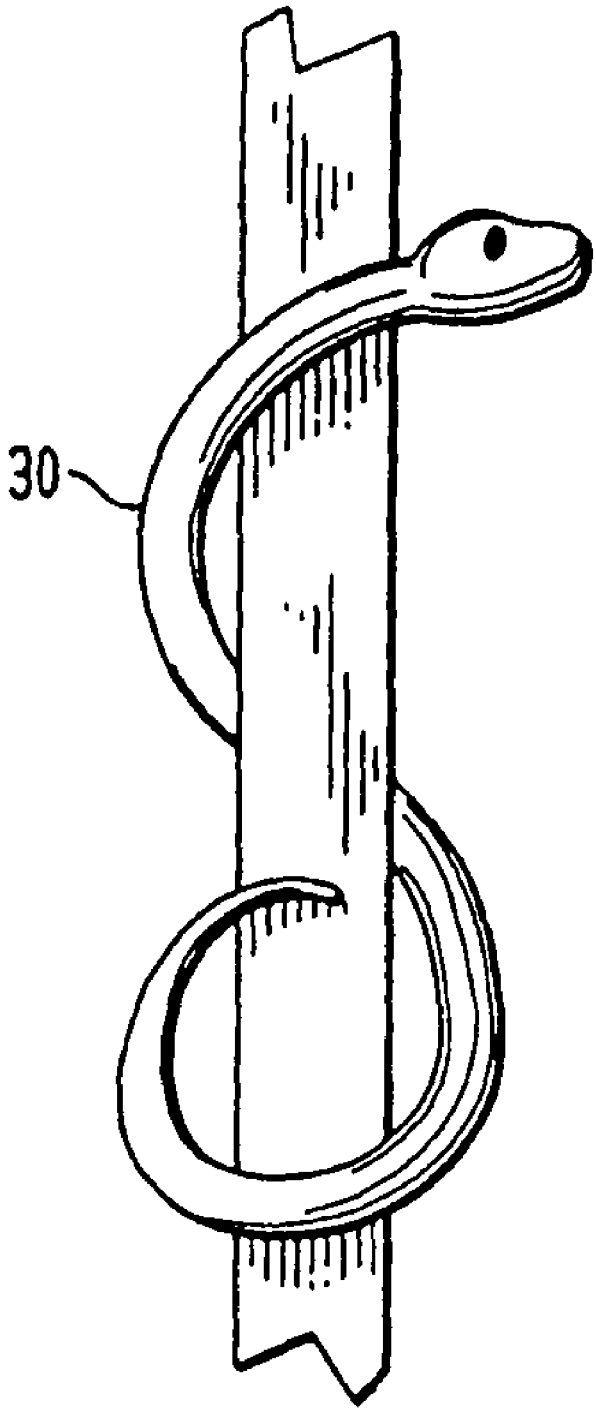
FIG. 9 is a front view of an alternate clasp usable with the present invention.
Figure 10:
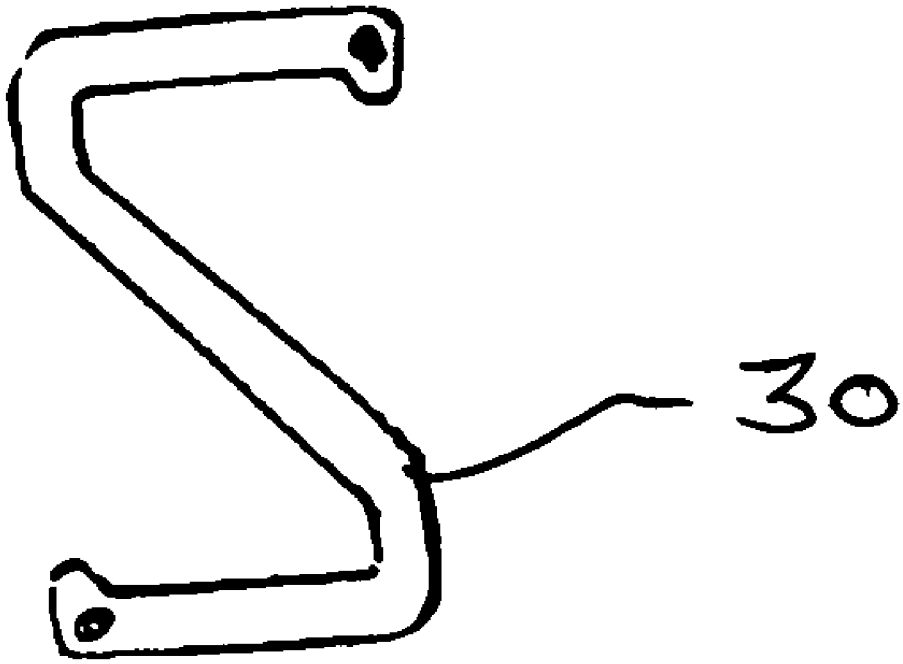
FIG. 10 is a front view of a serpentine slide of the present invention.

Finally in FIG. 9 and FIG. 10, taken along with FIGS. 1-8, there is a front view of a stylized clasp or slide 30 that can be wrapped around the strap of the bra or other undergarment, and which has a serpentine configuration that surrounds the strap and yet is available to attach the hooks 22, FIGS. 2 and 3, to affix the necklace 16 in position at the neck of the wearer.

While the preferred embodiments have been described and illustrated, various modifications and substitutions may be made without departing from the scope and spirit of this invention. It is to be understood, therefore, that the present invention has been described by way of illustration and not limitation.

I claim:

1. A combination of a garment adapted to be worn by a wearer and a necklace located at a visible location, the combination comprising:

a garment having a pair of straps adapted to be worn by the wearer at the shoulders of the wearer, each of said straps having a plurality of vertically spaced apart discrete decorative securing devices located therealong;

a necklace having free ends, a decorative affixation device located at each of the free ends of the necklace, each of said affixation devices adapted to be affixed to a decorative securing device located on each of the straps of the garment wherein the necklace is positioned by the affixation of the affixing devices to the decorative securing devices on the straps to be located at the visible location on the person, wherein said decorative affixing device comprises a serpentine wraparound slide.

* * * * *